US007553380B2

(12) United States Patent
Ikeda et al.

(10) Patent No.: US 7,553,380 B2
(45) Date of Patent: Jun. 30, 2009

(54) DUAL-PHASE STEEL SHEET EXCELLENT IN STRETCH FLANGE FORMABILITY AND PRODUCTION METHOD THEREOF

(75) Inventors: Shushi Ikeda, Kobe (JP); Hiroshi Akamizu, Kobe (JP); Shunichi Hashimoto, Kakogawa (JP); Takahiro Kashima, Kakogawa (JP); Tatsuya Asai, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 272 days.

(21) Appl. No.: 11/541,748

(22) Filed: Oct. 3, 2006

(65) Prior Publication Data

US 2007/0023113 A1 Feb. 1, 2007

Related U.S. Application Data

(63) Continuation of application No. 10/262,317, filed on Oct. 2, 2002, now abandoned.

(30) Foreign Application Priority Data

Oct. 3, 2001 (JP) ..... 2001-307731
Dec. 20, 2001 (JP) ..... 2001-387319

(51) Int. Cl.
*C22C 38/04* (2006.01)
*C22C 38/06* (2006.01)
*C21D 8/00* (2006.01)

(52) U.S. Cl. ..... 148/320; 148/533; 148/602; 148/653; 148/654

(58) Field of Classification Search ..... 148/533, 148/534, 601–603, 661, 650–654, 320, 330–336
See application file for complete search history.

(56) References Cited

U.S. PATENT DOCUMENTS 6,306,527 B1 10/2001 Ikeda et al.
6,316,127 B1 11/2001 Ikeda et al.
2007/0023113 A1 2/2007 Ikeda et al.

FOREIGN PATENT DOCUMENTS

EP 0 952 235 10/1999
EP 1 096 029 5/2001
EP 1 193 322 4/2002

(Continued)

OTHER PUBLICATIONS

Patent Abstract of Japan, JP 9-095731, Apr. 8, 1997.

(Continued)

*Primary Examiner*—Deborah Yee
(74) *Attorney, Agent, or Firm*—Oblon, Spivak, McClelland, Maier & Neustadt, P.C.

(57) ABSTRACT

Disclosed is a dual-phase steel sheet having low yield ratio, excellent in the balance for strength-elongation and for strength-stretch flange formability, and also excellent in bake hardening property containing (on the mass % basis).
C: 0.01-0.20%,
Si: 0.5% or less,
Mn: 0.5-3%,
sol.Al: 0.06% or less (inclusive 0%),
P: 0.15% or less (exclusive 0%), and
S: 0.02% or less (inclusive 0"), and in which
the matrix phase contains tempered martensite; tempered martensite and ferrite; tempered bainite; or tempered bainite and ferrite, and
the second phase comprises 1 to 30% of martensite at an area ratio based on the entire structure.

11 Claims, 5 Drawing Sheets

FOREIGN PATENT DOCUMENTS

| | | |
|---|---|---|
| JP | 55-122821 | 9/1980 |
| JP | 58-39770 | 3/1983 |
| JP | 2-175817 | 7/1990 |
| JP | 409025538 | 1/1997 |
| JP | 409263884 | 10/1997 |
| JP | 2001-207221 | 7/2001 |
| JP | 2001-207235 | 7/2001 |
| WO | WO 00/03041 | 1/2000 |
| WO | WO 01/64967 | 9/2001 |

OTHER PUBLICATIONS

Patent Abstract of Japan, JP 9-025538, Jan. 26, 1997.
U.S. Appl. No. 11/910,029, filed Sep. 28, 2007, Akamizu et al.
U.S. Appl. No. 11/910,013, filed Sep. 28, 2007, Kashima et al.
U.S. Appl. No. 11/736,813, filed Apr. 18, 2007, Kashima.

CONTINUOUS ANNEALING CONDITION

CONTINUOUS ANNEALING CONDITION

DUAL-PHASE STEEL SHEET EXCELLENT IN STRETCH FLANGE FORMABILITY AND PRODUCTION METHOD THEREOF

This application is a Continuation of Case Ser. No. 10/262,317 filed Oct. 2, 2002, now abandoned.

BACKGROUND OF THE INVENTION

1. Field of the Invention

The present invention relates to a dual-phase steel sheet excellent in bake hardening property capable of ensuring high strength by applying coating and baking (hardening property after bake coating, hereinafter sometimes referred to as BH (Bake Hardening) property) and a stretch flange formability. Specifically, this invention relates to a high strength dual-phase steel sheet excellent in the bake hardening property described above and having a low yield ratio, as well as excellent in the balance for strength-elongation and the balance for strength-stretch flange formability.

2. Description of Related Art

Steel sheets used by pressing in the industrial fields such as for automobiles, electric apparatus and machineries are required to have both excellent strength and ductility together and such demands for the characteristics have been increased more and more in recent years.

As steel sheets intended for making the strength and the ductility compatible, ferrite-martensite dual-phase steel sheets comprising a ferritic structure as a matrix phase in which coarse island-like martensite is dispersed at the triple point of the ferrite (dual-phase (DP) steel sheet) have been known so far (for example in JP-A No. 122821/1980).

It has been known that the DP steel sheet described above is not only excellent in ductility but also excellent in bake hardening property (BH property). In the DP steel sheet, a great amount of C solid solubilized at super saturation in ferrite (solid solution C) are present since the sheet is manufactured by quenching from a temperature of $A_1$ point or higher. It is considered that the yield strength of the steel sheet is increased and the BH property is enhanced by fixing of solid solubilized C to dislocations of the ferrite introduced during working by the bake coating step after the working. However, since the amount of solid solution C that can be present at super saturation in the ferrite is limited, it was difficult to obtain BH property above a certain level.

Further, while the DP steel sheet has high tensile strength (TS) at low yield ratio and also has excellent elongation (El) property, since coarse martensite induces trigger for fracture, it was poor in the stretch flange formability (local ductility: λ).

Then, in order to improve the stretch flange formability in the DP steel sheet, the present applicant has already disclosed a tri-phase steel sheet comprising ferrite, bainite, and martensite [Tri-Phase (TP) steel sheet] (JP-A No. 39770/1983). In the steel sheet described above, since martensite inducing fracture is surrounded by the bainite phase, the stretch flange formability is improved compared with existent DP steel sheets. However, it has been found that the steel sheet involves problems that it is difficult to obtain a high ductility (high elongation) at a level identical with that of the existent DP steel sheet and the yield ratio is increased somewhat.

Accordingly, it has been strongly demanded for the provision of a high strength dual-phase steel plate capable of maintaining (i) low yield ratio and (ii) favorable strength-elongation balance and, in addition, further intending to improve (iii) BH property [(i) low yield ratio, (ii) favorable strength-elongation balance and (iii) high BH property is the features of the DP steel sheets], as well as capable of overcoming (iv) low stretch flange formability as the drawback of the existent DP steel plate and also excellent in the stretch flange formability.

OBJECT AND SUMMARY OF THE INVENTION

Under the circumstances, the present invention aims to provide a dual-phase sheet plate excellent in bake hardening property and stretch flange formability capable of solving the foregoing subject, as well as a method of producing such a steel sheet efficiently.

In one aspect according to this invention, a dual-phase steel sheet of excellent bake hardening property and stretch flange formability contains, on the mass % basis (here and hereinafter), C: 0.01-0.20%,
Si: 0.5% or less,
Mn: 0.5-3%,
sol.Al: 0.06% or less (inclusive 0%),
P: 0.15% or less (exclusive 0%), and
S: 0.02% or less (inclusive 0"), in which the matrix phase contains tempered martensite; tempered martensite and ferrite; tempered bainite; or tempered bainite and ferrite, and the second phase comprises from 1 to 30% of martensite as an area ratio based on the entire structure.

Another aspect of this invention resides in the following six preferred embodiments:

1. sol.Al is controlled to 0.025% or less.

2. The dual-phase steel sheet further contains 0.0050% or more of N and satisfies the following relation (1):

$$0.001\% \leqq [N]-(14/27)\times[sol.Al] \leqq 0.001\% \quad (1)$$

(where [ ] represents the content for each element).

3. The dual-phase steel sheet further containing 1% or less of Cr and/or Mo in total (exclusive 0%).

4. The dual-phase steel sheet further contains Ni: 0.5% or less (exclusive 0%) and/or Cu: 0.5% or less (exclusive 0%).

5. The dual-phase steel sheet further contains at least one of Ti: 0.1% or less (exclusive 0%), Nb: 0.1% or less (exclusive 0%), V: 0.1% or less (exclusive 0%).

6. The dual-phase steel sheet further contains Ca: 0.003% less (exclusive 0%), and/or REM: 0.003% (exclusive 0%).

In still another aspect according to this invention, the method of producing the steel sheet for overcoming the foregoing subject has a feature in providing the methods described below in view of the structure.

A: Steel Sheet Having Matrix Phase Comprising Tempered Martensite or Tempered Bainite The following method (1) and (2) can be adopted.

(1) A method of producing a dual-phase steel sheet in which the matrix phase is tempered martensite or tempered bainite by applying an hot rolling step and a continuous annealing step or galvanization step, wherein the hot rolling step includes a step of completing finish rolling at a temperature of $(A_{\gamma 3}-50)°$ C. or higher; and a step of cooling and at an average cooling rate of 20° C./s or more down to Ms point or lower (in the case where the matrix phase comprises tempered martensite), or Ms point or higher and Bs point or lower (in the case where the matrix phase comprises tempered bainite), followed by coiling and the continuous annealing step or galvanization step includes a step of heating to a temperature of $A_1$ point or higher and $A_3$ point or lower; and a step of cooling at an average cooling rate of 3° C./s or more and cooling down to Ms point or lower; and, optionally, a step of further applying averaging at a temperature from 100 to 600° C.

(2) A method of producing a dual-phase steel sheet in which the matrix phase is tempered martensite or tempered bainite by applying a hot rolling step, a cold rolling step, a first continuous annealing step and a second continuous annealing step or a galvanization step, wherein the first continuous annealing step includes a step of heating to and retaining at a temperature of $A_3$ point or higher; and a step of cooling at an average cooling rate of 20° C./s or more down to a temperature of Ms point or lower (in the case where the matrix phase comprises tempered martensite), or Ms point or higher and Bs point or lower (in the case where the matrix phase comprises tempered bainite), and the second continuous annealing step or galvanization step includes a step of heating at a temperature of $A_3$ point or higher and $A_3$ point or lower; a step of cooling at an average cooling rate of 3° C./s or more down to a temperature of Ms point or lower; and, optionally, a step of further applying averaging at a temperature from 100 to 600° C.

B: Steel sheet in which the matrix phase is tempered martensite and ferrite, or tempered bainite and ferrite The following method (3) and (4) can be adopted.

(3) A method of producing a dual-phase steel sheet, in which the matrix phase is tempered martensite and ferrite or tempered bainite and ferrite, by applying a hot rolling step, and a continuous annealing step or a galvanization step, wherein the hot rolling step includes a step of completing finish rolling at a temperature of $(A_{\gamma 3}-50)$° C. or higher; and a step of cooling and at an average cooling rate of 10° C./s or more down to Ms point or lower (in the case where the matrix phase comprises tempered martensite and ferrite), or Ms point or higher and Bs point or lower (in the case where the matrix phase comprises tempered bainite and ferrite), followed by coiling, and the continuous annealing step or galvanization step includes a step of heating to a temperature of $A_1$ point or higher and $A_3$ point or lower; and a step of cooling at an average cooling rate of 3° C./s or more down to Ms point or lower; and, optionally, a step of further applying overaging at a temperature from 100 to 600° C.

(4) A method of producing a dual-phase steel sheet in which the matrix phase is tempered martensite and ferrite or tempered bainite and ferrite, by applying a hot rolling step, a cold rolling step, a first continuous annealing step and a second continuous annealing step or a galvanization step, wherein the first continuous annealing step includes a step of heating to and retaining at a temperature of $A_1$ point or higher and $A_3$ point or lower; and a step of cooling at an average cooling rate of 10° C./s or more down to a temperature of Ms point or lower (in the case where the matrix phase comprises tempered martensite and ferrite), or Ms point or higher and Bs point or lower (in the case where the matrix phase comprises tempered bainite and ferrite), and the second continuous annealing step or galvanization step includes a step of heating at a temperature of $A_1$ point or higher and $A_3$ point or lower; and a step of cooling at an average cooling rate of 3° C./s or more down to a temperature of Ms point or lower and, optionally, a step of further applying overaging at a temperature from 100 to 600° C.

In a preferred embodiment for the method (3) described above, the hot rolling step includes a step of completing the finish rolling at a temperature of $(A_{\gamma 3}-50°$ C.) or higher; a step of cooling at an average cool rate of 30° C./s or more down to a temperature region in a range of 700±100° C.; a step of conducting air cooling for 1 to 30 sec in the temperature region; and a step of cooling at an average cooling rate of 30° C./s or more down to a temperature of Ms point or lower (in the case where the matrix phase comprises tempered martensite and ferrite) or Ms point or higher and Bs point or lower (in the case where the matrix phase comprises tempered bainite and ferrite), after air cooling, followed by coiling.

Other and further objects, features and advantages of the invention will appear more fully from the following description.

DETAILED DESCRIPTION OF THE PREFERRED EMBODIMENTS

Figure 1:
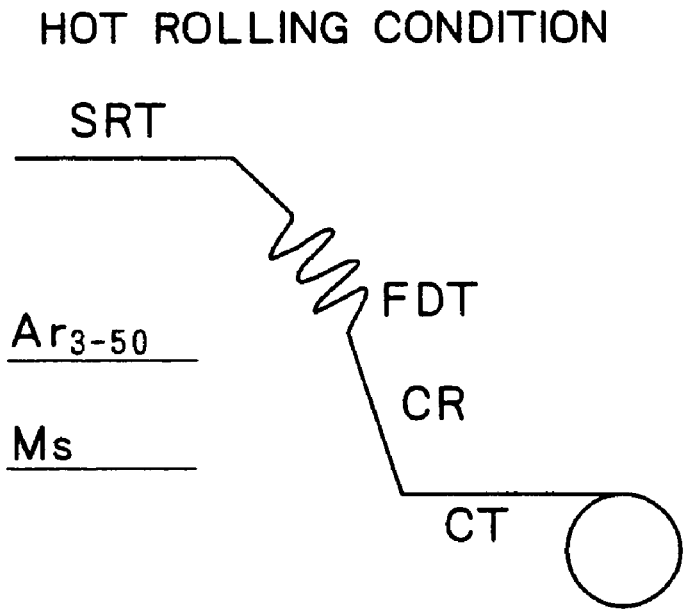
FIG. 1 is an explanatory view for a hot rolling step in the method (1) in which a matrix phase is tempered martensite or tempered martensite+ferrite.

The present inventors have made an earnest study for providing a high strength steel sheet intended for maintaining low yield ratio and favorable strength—elongation balance which are the feature of DP steel sheets and, in addition, intending a further improvement for high BH property and capable of overcoming low stretch flange formability which was a drawback of the DP steel sheets and also excellent in the stretch flange formability. As a result, this invention has been accomplished based on the finding that a further improvement for the characteristics can be provided in that:

(1) a matrix phase comprising a soft lath structure of low dislocation density and containing (i) tempered martensite structure, (ii) a mixed structure of tempered martensite and ferrite, (iii) tempered bainite, and (iv) mixed structure of tempered bainite and ferrite, respectively, is extremely effective for the improvement of the stretch flange formability and total elongation; and a DP steel sheet comprising such a matrix structure and a second phase having fine martensite can improve the stretch flange formability remarkably while ensuring excellent low yield ratio, and excellent balance for strength and ductility (elongation) in existent DP steel sheets;

(2) excellent bake hardening property can be obtained further by effectively controlling the above-described structure;

(3) N in the steel acts effectively as solid solution N capable of fixing dislocations introduced during working by decreasing the amount of sol.Al in addition to the control of the structure further thereby improving the bake hardening property further, and (4) a further improvement for the property can be obtained, more preferably, by increasing the amount of N and the amount of effective N contributing to the bake hardening property.

For the mechanism of "BH property", it is considered that since dislocations in the ferrite introduced by working are fixed to C in the steel (solid solution C) to cause hardening by the heat treatment after the working and, as a result, the tensile yield stress is increased. For "BH amount", a deformation stress $\sigma_1$ upon pulling a tensile test coupon (usually, JIS No. 5 test specimen) to 2% nominal distortion is measured, stress is removed and then the test specimen is kept at 170° C. for 20 min and the upper yield stress $\sigma_2$ upon conducting the tensile test again (stress corresponding to 0.2% strength in a case where the yield point does not appear) is measured. Then, the BH amount was defined as the difference between $\sigma_1$ and $\sigma_2$.

In this invention, the aimed value for the BH amount is defined as 50 MPa or more (preferably, 70 MPa or more).

Further, this invention also intends to increase the tensile strength (ΔTS) in relation with a further increase of the BH property. Generally, in a case of increasing the BH property, no increased tensile strength can be obtained sometimes while only the yield strength is increased. When the deformation stress after yield increases along with the increase in the BH amount, kinetic energy absorbed by the deformation of the material is further increased. Accordingly, in a case of assumed collision of an automobile, since energy exerting on a driver or the like is decreased upon collision as the kinetic energy that the material can absorb is larger, the corrosion safety of the automobile is improved. In view of the above, this invention intends for increased ΔTS property in addition to the improvement in the BH property.

The ΔTS property means such a characteristic that the tensile strength in a case of applying treatment after working is increased more compared with the tensile strength before the heat treatment. In a specific measuring method, after giving 10% nominal tensile strain to a tensile test coupon (usually, JIS No. 5 test specimen) and removing the load, the test specimen is kept at 170° C. for 20 min and a maximum stress T2 upon conducting the tensile strength again was measured. Then, a difference relative to the maximum stress T1 when conducting the tensile test up to fracture without heat treatment (T2−T1) was defined as the ΔTS amount.

In this invention, the aimed value for the ΔTS amount is defined as 30 MPa or more (preferably, 50 MPa or more).

Detailed reasons why the excellent effects described above can be obtained in this invention are not apparent, but it is considered that in a case where the matrix phase has the structure (i) to (iv) comprising the soft lath structure, since martensite/bainite formed in the process for forming the structure (tempering process) is formed between the lath structures, the structure becomes extremely fine and, as a result, the stretch flange formability is improved and, at the same time, the elongation property is further improved.

Further, increase in the BH property and the ΔTS property may be considered as below. That is, since the matrix phase softened by tempering (tempered martensite/tempered bainite) is deformed upon working of material in which a great number of dislocations are introduced and, in addition, since the tempered matrix phase itself contains a great amount of super saturated C compared with ferrite, the amount of C capable of fixing the dislocation introduced during working (amount of solid solution C) is also increased to result in high bake hardening property. As described above, it is considered in the steel sheet according to this invention that since not only the ferrite but also the tempered martensite/tempered bainite contribute to the bake hardening property, the hardening amount is further increased and, in addition, the tensile strength by the heat treatment after working is also increased and, as a result, the ΔTS property is also improved.

In contrast, existent dual-phase steel sheet has no tempered matrix phase as a feature of this invention in which not tempered martensite is extremely hard and scarcely deforms. Accordingly, since only the ferrite introduced with a great amount of dislocations is attributable to a most portion of the bake hardening property, it is considered that the bake hardening property is lower compared with the steel sheet according to this invention.

Each of the factors constituting this invention is to be explained below.

At first, matrix phase (i) to (iv) which is the most characterizing feature of the invention is to be described.

(i) Form comprising tempered martensite structure as matrix phase

"Tempered martensite" in this invention means those being soft, at less dislocation density, and having a lath-like structure. In contrast, martensite is different from the tempered martensite in that this is a hard structure of high dislocation density and they are distinguished, for example, based on observation by a transmission type electron microscope (TEM). Further, this is also different regarding the tempered martensite as the matrix phase, from the existent DP steel sheets having no tempered martensite as the matrix phase.

The tempered martensite can be obtained as will be described later, for example, by annealing the martensite which has been quenched hardened from $A_3$ point or higher (γ region), at a temperature of $A_1$ point or higher (about 700° C. or higher) and $A_3$ point or lower.

In order to effectively provide the improving effect for the stretch flange formability, BH property and ΔTS property by the tempered martensite, it is recommended to contain the tempered martensite by 30% or more (more preferably, 40% or more, and further preferably, 50% or more and, furthermore preferably, 60% or more). The amount of tempered martensite is determined in view of the balance with the second phase martensite and it is recommended to properly control the amount of tempered martensite so as to provide a desired characteristic.

(ii) Form comprising a mixed structure of tempered martensite and ferrite as matrix phase In the formed described above, details for the tempered martensite are as described in (i) above.

"Ferrite" in this invention means polygonal ferrite, that is, ferrite with less dislocation density. The ferrite has a merit such as excellent elongation property but involves a drawback of poor stretch flange formability. In contrast, the steel sheet according to this invention having a mixed structure of the ferrite and the tempered martensite possesses excellent elongation property and, in addition, improved the stretch flange formability, as well as excellent in the BH property and the ΔTS. In this regard, this is different, both in the constitution of the structure and the obtained property, from the existent DP steel sheets.

In order to effectively provide the effect according to this invention, it is recommended to incorporate the ferrite by 5% or more (preferably, 10% or more). However, since necessary strength is difficult to be ensured, as well as many voids are formed from the boundaries between the ferrite and the second phase to deteriorate the stretch flange formability like existent DP steel sheets when the content exceeds 60%, it is recommended to define the upper limit as 60%. When the upper limit is controlled to less than 30%, since the boundaries between the ferrite and the second phase (martensite) is decreased to suppress the source for the occurrence of voids, the stretch flange formability can be improved which is extremely preferred.

(iii) Form comprising tempered bainite as matrix phase

"Tempered bainite" in this invention means those being soft with less dislocation density and having a lath-like structure. In contrast, bainite is different from the tempered bainite in that it is a hard structure with high dislocation density and they are distinguished, for example, based on observation by a transmission type electron microscope (TEM). Further, since it has the tempered bainite as the matrix phase, it is also different, having the tempered martensite as the matrix phase, from existent DP steel sheets having no tempered bainite as the matrix phase.

The tempered bainite can be obtained as will be described later, for example, by annealing bainite which has been quenched from $A_3$ point or higher (γ region), at a temperature of $A_1$ point or higher (about 700° C. or higher) and $A_3$ point or lower.

In order to effectively provide the effect of improving the stretch flange formability, the BH property and the ΔTS property by the tempered bainite, it is recommended to incorporate the tempered bainite by 30% or more (preferably, 40% or more, further preferably, 50% or more and, further more preferably, 60% or more). The amount of the tempered bainite is determined in view of the balance with the martensite to the described later and it is recommended to properly control the amount of the tempered bainite in order to provide a desired property.

(iv) Form comprising tempered bainite and ferrite as matrix phase

Details for each of the structures (tempered bainite and ferrite) for the form are as has been described in (iii) and (ii) above.

Then, for each of the forms, the martensite as the second phase is to be described.

Generally, while the martensite is a structure effective to the improvement of the strength, incorporation of great amount results in a problem such as lowering of elongation. Further, in a case where coarse martensite is present in the ferrite matrix as in the existent DP steel sheets, since the martensite induces fracture, it results in a problem such as lowering of the stretch flange formability. However, in a case where the matrix phase has the structure (i) to (iv) comprising the soft lath-like structure as described above, it is considered that martensite is dispersed finely between the lath and, accordingly, the stretch flange formability is improved and, in addition, the elongation property is further improved.

As described above, the martensite in this invention, is fine different from existent martensite. Specifically, it is observed in the grains and at the grain boundary of the matrix phase by optical microscopic observation and, particularly, the second phase martensite in the matrix phase grains is formed in an elongate shape between the lath-like structures and, further, it can be distinguished also from existent island-like martensite by the observation of a transmission type electron microscope (TEM).

In order to effectively provide the effect of such a fine martensite, the martensite is incorporated in each of the forms described above by 1% or more (preferably 3% or more and, more preferably, 5% or more) as the area ratio based on the entire structure. However, since incorporation by a great amount results in excessive increase in the strength to lower the elongation and deteriorate the balance between the strength and the elongation, so that the upper limit is defined as 30% (preferably, 25%). More specifically, it is recommended to properly control the preferred area ratio of the martensite depending on the kind of the matrix phase.

Others: Bainite or retained austenite (inclusive 0%)

The steel sheet according to this invention may comprise only the matrix phase and the second phase but it may contain bainite as other different kind of structure within a range as not deteriorate the effect of the invention. The bainite structure can be remained naturally, for example, in the production process according to this invention to be described later [for example, in a step of cooling at an average cooling rate of 3° C./s or more down to Ms point or lower in "continuous annealing step or galvanization step" in (1) or (3) described above, or "second continuous annealing step or galvanization step" in (2) or (4)"; or in a step of alloying after the method (1)-(4) described above]. It is preferred that less bainite structure is contained.

Further, depending on the chemical compositions of the steel species used, fine retained austenite may sometimes remain.

Then, basic chemical compositions constituting the steel sheet according to this invention are to be described. All the units for the chemical compositions are based on mass %.

C: 0.01-0.20%

C is an element essential to the formation of the martensite contributing to the improvement of the strength, and the strength of the steel sheet in this invention is mainly determined by the area ratio and the hardness of martensite. In this invention, after heating to 2-phase region (α+γ) in the final heat treatment step ["continuous annealing step or galvanization step" in (1) or (3) described above, or "second continuous annealing step or galvanization step" in (2) or (4) described above], it is cooled to transform the γ phase into the martensite. The area ratio of the γ phase during heating (that is, the martensite area ratio after cooling) is greatly effectuated, for example, by the amount of C in the steel and it is difficult to ensure the necessary strength when the amount of C is small. The 2-phase region (α+γ) is narrowed, particularly, at 0.01% or less to worsen the productivity. Accordingly, the lower limit is defined as 0.01% (preferably, 0.02%). However, when C exceeds 0.20%, the spot weldability is deteriorated remarkably, as well as the increase of the martensite area ratio in the steel sheet not only deteriorates the workability but also increases the yield ratio. Accordingly, the upper limit is defined as 0.20% (preferably, 0.15%).

Si: 0.5% or less

Si is an element contributing to the improvement of ductility such as elongation by decreasing the amount of the solid solution C in the a phase. In order to effectively provide such an effect, it is preferably added by 0.05% or more (more preferably, 0.1% or more). However, since galvanization failure occurs, for example, in a case of zinc galvanization when Si is added in excess of 0.5%, the upper limit is defined as 0.5% (preferably, 0.3%).

Mn: 0.5-3%

Mn is useful as a solid solution strengthening element and also is an element necessary for stabilizing the γ phase by suppressing transformation in the cooling process. Further, it is useful for forming a desired martensite phase. In order to effectively provide such an effect, it is added by 0.5% or more (preferably, 0.7% or more and, more preferably, 1% or more). However, since Mn deteriorates the galvanization property upon zinc galvanization when added in excess of 3%, the upper limit is defined as 3% (preferably, 2.5% or less and, more preferably, 2% or less).

sol.Al (acid soluble al): 0.06% or less

Al prevents formation of cementite and is useful as a γ phase stabilizing element by thickening C. However, since addition by a great amount results in formation of oxides to lower elongation or stretch flange formability, the upper limit is defined as 0.06% with a view point described above. It is preferably, 0.05% or less.

On the other hand, with a view point of improving the bake hardening property, Al is an element which has to be controlled in order to ensure effective solid solution N (to be described later) for ensuring excellent bake hardening property and increasing the tensile strength. If it is present in a great amount, it is combined with solid solution N tending to form Al nitrides (AlN) and no further improvement can be expected for the BH amount and the ΔTS amount. Further, even when the solid solution N can be ensured sufficiently and AlN is formed, it is necessary that the AlN does not deteriorate the characteristics such as elongation or stretch flange formability. For this purpose, it is recommended in this invention that the upper limit for sol.Al is 0.025%, particularly, with a view point of improving the bake hardening property in this invention. While the Al content is desirably as less as possible, it is recommended to define the content as 0.005% or more at a practical level while considering the productivity or the like. As a method of decreasing the amount of sol.Al in the steel, it is useful, for example, to conduct deoxidation in the steel making process with Si instead of Al.

P: 0.15% or less (exclusive 0%)

P is useful as a solid solution reinforcing element and this is an element for controlling the decomposition of the γ phase in the cooling process. In order to effectively provide such an effect, it is recommended to add P by 0.03% or more (more preferably, 0.05% or more). However, when P is added in excess of 0.15%, the ductility is deteriorated. It is preferably 0.1% or less.

S: 0.02% or less (inclusive 0%)

Since S is an element of forming sulfide type inclusions such as MnS upon hot rolling, which induces cracking and deteriorates the workability, as well as lowers the ductility in the cold state, the upper limit is defined as 0.02%. It is preferably 0.015% or less.

The steel according to this invention contains the chemical compositions described above as the basic chemical compositions with the balance being substantially iron and impurities. It is recommended to properly control the amount of N as described below, particularly, for obtaining a desired BH property.

N: 0.0050% or more $$0.0001\% \leqq [N]-(14/27)\times[sol.Al] \leqq 0.001\% \quad (1)$$

(where [ ] shows the content for each element)

As described above, solid solution N is useful for the improvement of the bake hardening property and the tensile strength. Generally, usual dual-phase steel sheets contain N in an amount of about 0.003 to 0.004% and such a range is permissible also in this invention. However, with a view point of ensuring the desired amount of solid solution N more effectively together with reduction for the amount of Al described above, it is recommend to add N by 0.0050% or more. It is preferably 0.0060% or more and, more preferably, 0.0070% or more.

Further, the relation (1) described above defines the amount of solid solution N required for "ensuring the aimed amount of BH (50 MPa or more) and amount of ΔTS (30 MPa or more) in this invention" with a view point of properly controlling the amount of solid solution N in relation with the amount of sol.Al thereby obtaining desired bake hardening property and tensile strength, while considering the balance with the amount of sol.Al. That is, {[N]−(14/27)×[sol.Al]} represented by the relation (1) means an effective amount of N essentially contributing to the improvement of the characteristic [numerical value represented by the relation (1) above is sometimes referred to as "amount of effective N"]. When the N content is excessive, since this results in bubbles in the steel ingots during preparation to cause cracking or breakage in the hot rolling step, it is recommended to define the upper limit for the amount of effective N as 0.001%.

Further, in this invention, the following allowable chemical compositions may be added within a range not deteriorating the effect of the invention.

B: 0.003% or less (exclusive 0%)

B has an effect of an improving the hardening property and improving the strength by a small amount. In order to effectively provide such an effect, it is recommended to add B by 0.0005% or more. However, when it is added in excess, since grain boundary is embrittled to cause cracking by the treatment such as casting or rolling, the upper limit is defined as 0.003%. It is more preferably, 0.002% or less.

Cr and/or Mo 1% or less in total (exclusive 0%)

Since Cr and Mo are effective elements to improve the hardening property and increase the strength of the steel, it is recommended to add Cr and/or Mo by 0.1% or more in total. However, since excess addition merely results in saturated effect and deteriorates the ductility, it is preferred to suppress Cr and/or Mo to 1% or less in total. It is more preferably 0.8% or less in total.

The elements described above may be used alone or may be used in combination.

Ni: 0.5% or less (exclusive 0%) and/or

Cu: 0.5% or less (exclusive 0%)

The elements are effective to attain higher strength while keeping favorable strength-ductility balance and in order to effectively provide the effect, it is recommended to add Ni: 0.1% or more and/or Cu: 0.1% or more. However, since excess addition of the elements merely results in saturated effect and deteriorates productivity such as causing cracking during hot rolling, it is preferred to suppress as Ni: 0.5% or less and/or Cu: 0.5% or less.

Ca and/or REM: 0.003% or less (exclusive 0%)

Ca and REM (Rare Earth Metal elements) are effective elements for controlling the form of sulfides in the steel to improve the workability. The rare earth elements in this invention can include, for example, Sc, Y and lanthanoids. In order to effectively provide the effect, it is recommended to add them by 0.0003% or more (more preferably, 0.0005% or more). However, when it is added in excess of 0.003%, the effect described above is saturated to provide economical loss. It is more preferably, 0.0025% or less.

At least one of Ti: 0.1% or less (exclusive 0%)

Nb: 0.1% or less (exclusive 0%),

V: 0.1% or less (exclusive 0%)

Each of the elements is a carbon nitride forming element. When carbon nitrides are precipitated, crystal grains in the a phase and the γ phase become fine when heated to the (α+γ) region contributing to the improvement of the strength. In order to effectively provide such an effect, it is recommended to add Ti: 0.01% or more (more preferably, 0.02% or more), Nb: 0.01% or more (more preferably, 0.02% or more), V: 0.01% or more (more preferably, 0.02% or more), respectively. However, when each of the elements is added in excess of 0.1%, the yield ratio is increased by precipitation hardening. It is more preferably, Ti: 0.08% or less, Nb: 0.08% or less and V: 0.08% or less.

Then, the method of producing the steel sheet according to this invention is to be described for each of the forms.

A: Steel sheet in which the matrix phase is tempered martensite or tempered bainite Typical production method of the steel sheet described above includes the following method (1) or (2). Each of the methods is to be described in details.

(1) [Hot rolling step]→[continuous annealing step or galvanization step]

Figure 2:
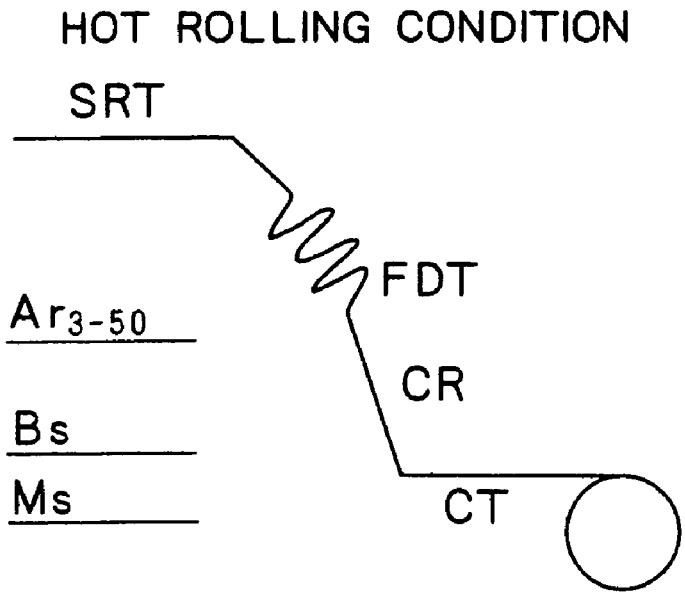
FIG. 2 is an explanatory view for a hot rolling step in the method (1) in which a matrix phase is tempered bainite or tempered bainite+ferrite.
Figure 3A:
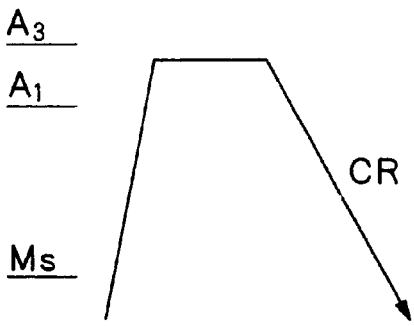
FIG. 3 is an explanatory view for the continuous annealing or galvanization step in the method (1)
Figure 3B:
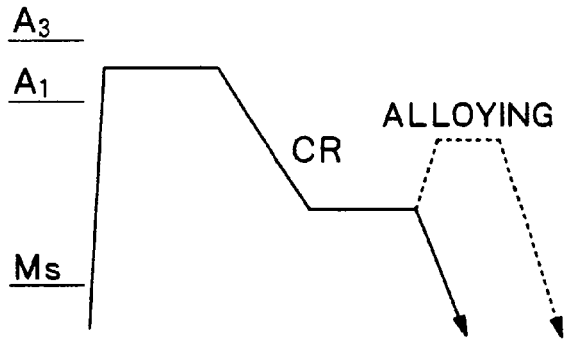
Figure 3C:
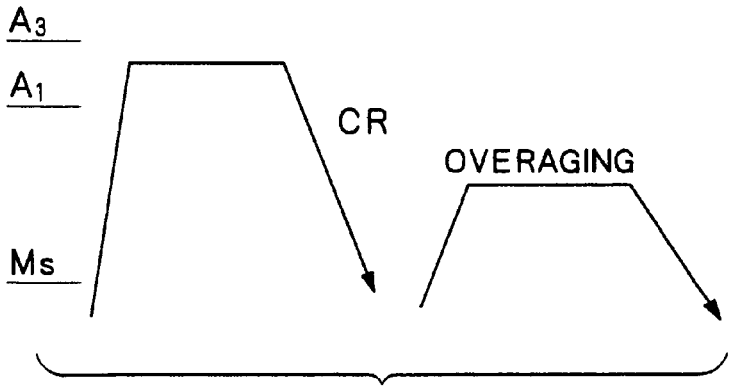

This is a method of producing a desired steel sheet by way of (i) hot rolling step and (ii) continuous annealing step or galvanization step. For the method, FIG. 1 is an explanatory view for (i) hot rolling step (in a case where the matrix phase is quenched martensite), FIG. 2 is an explanatory view (in a case where the matrix phase is quenched bainite) and FIG. 3 is an explanatory view for (ii) continuous annealing step or galvanization step, respectively.

(i) Hot rolling step:

The hot rolling step includes a step of completing the finish rolling at a temperature of ($A_{\gamma 3}$-50)° C. or higher; and a step of cooling at an average cooling rate of 20° C./s or more down to Ms point or lower (in a case where the matrix phase is tempered martensite) or Ms point or higher and Bs point or lower (in a case where the matrix phase is tempered bainite), followed by coiled. The hot rolling conditions are set so as to obtain a desired matrix phase (quenched martensite or quenched bainite).

At first, in any case of obtaining the matrix phase, it is recommended to set the hot rolling finishing temperature (FDT) as ($A_{\gamma 3}$-50)° C. or higher, preferably, $A_{\gamma 3}$ point or higher. This is because for obtaining a desired quenched martensite or quenched bainite together with "cooling at Ms point or lower" or "cooling at Ms point or higher and Bs point or lower" to be practiced successively.

Cooling is applied after the hot rolling finishing and it is recommended to conduct cooling under the cooling condition (CR) at an average cooling rate of 20° C./s or higher (preferably 30° C./s or higher) down to Mn point or lower while avoiding ferritic transformation or pearlitic transformation. Thus, desired quenched martensite or quenched bainite can be obtained without forming polygonal ferrite or the like. The average cooling rate after the hot rolling gives an effect also on the form of the final martensite. Higher average cooling rate is more effective since the lath-like structure becomes finer and the second phase structure also becomes fine. There is no particular restriction on the upper limit of the average cooling rate and a higher level is more preferred, but it is recommended to properly control the same in view of the practical operation level.

Further, in a case of obtaining the quenched martensite, it is necessary that the coiling temperature (CT) is at the Ms point or lower [calculation formula: Ms=561−474×[C]−33×[Mn]−17%×[Ni] 0 17×[Cr]−21×[Mo]; where [ ] represents mass % for each of the elements]. This is because no desired quenched martensite can be obtained and bainite and the like are formed when CT exceeds Ms point.

On the other hand, in a case of obtaining the quenched bainite, it is necessary to define the coiling temperature [CT] is: Ms point or higher and Bs point or lower [calculation formula: Ms is identical with the formula described above; Bs=830−270×[C]−90×[Mn]−37×[Ni]−70×[Cr]−80×[Mo]; in which [ ] represents the mass % for each of the elements]. This is because no desired quenched bainite can be obtained when CT exceeds Bs point and, on the other hand, tempered martensite is formed when it is lower than Ms point.

In the hot rolling step, it is recommended to properly control each of the steps described above in order to obtain desired quenched martensite and quenched bainite. In other steps the heating or the like may be properly selected to those conditions practiced usually (for example, about 1000 to 1300° C.).

(ii) Continuous annealing or galvanization step

Succeeding to the hot rolling (i) described above, continuous annealing or galvanization is applied. However, in a case where the shape after the hot rolling is poor, cold rolling may be applied with an aim of amending the shape after conducting the hot rolling (i) and before conducting the continuous annealing or galvanization (ii). It is recommended to define the cold rolling rate as 1 to 50%, because rolling load increases making cold rolling difficult when cold rolling is applied at a ratio exceeding 50%. Particularly, in a case where the matrix phase is tempered martensite, it is preferred to define the cold rolling rate as 1 to 30%.

The continuous annealing or galvanization includes a step of heating at a temperature of $A_1$ point or higher and $A_3$ point or lower; and a step of cooling at an average cooling rate of 3° C./s or higher down to a temperature of Ms point or lower [FIG. 3(*a*)]; and, optionally, a step of further applying overaging at a temperature of 100 to 600° C. [FIG. 3(*c*)]. The conditions described above are set for tempering the matrix phase formed by the hot rolling step (quenched martensite or quenched bainite) to obtain desired tempered martensite or tempered bainite and also formed second phase (martensite).

At first, by soaking at a temperature of $A_1$ point or higher and $A_3$ point or lower, a desired structure (tempered martensite+martensite/tempered bainite+martensite) is formed (dual-phase region annealing). When the temperature described above is exceeded, all the structure is transformed into the γ phase, whereas all the structure is transformed into tempered martensite/tempered bainite when the temperature is lower than the level described above failing to obtain a desired second phase martensite. It is recommended that the retention time for the heating is defined as 10 to 600 sec during soaking. When it is less than 10 sec, tempering is insufficient failing to obtain a desired matrix phase (tempered martensite or tempered bainite). It is preferably 20 sec or more and, more preferably, 30 sec or more. When it exceeds 600 sec, lath-like structure as a feature of the tempered martensite or tempered bainite can no more be maintained to deteriorate mechanical characteristics. It is preferably 500 sec or less and, more preferably, 400 sec or less.

Then, the average cooling rate (CR) in FIG. 3 is controlled to 3° C./s or higher (preferably, 5° C./s or higher) and it is cooled to a temperature of Ms point or lower while avoiding pearlitic transformation. Thus, fine martensite can be obtained in a short period of time.

In this case, when the average cooling rate is lower than the range described above, no desired structure can be obtained but pearlite or the like is formed. There is no particular restriction for the upper limit and higher rate is more preferred. However, it is recommended to properly control the upper limit in view of the practical operation level.

Further, in the step described above, a bainite structure may be formed further, in addition to the desired matrix phase (tempered martensite or tempered bainite) and martensite, within a range not deteriorating the effect of the invention. Galvanization and, further, alloying treatment may also be applied without remarkably decomposing the desired structure within a range not deteriorating the effect of the invention. Specifically, the continuous galvanization line for a molten galvanized steel sheet or alloyed molten galvanized steel sheet may include a step of retaining at a temperature from 400 to 500° C. for a period from several seconds to several tens seconds with an aim of galvanization treatment after the cooling step [FIG. 3(*b*)]. The "averaging cooling rate (CR)" in a case of including the retention step (b) above does not contain the retention time.

Further, after cooling down to the temperature of Ms point or lower, averaging may optionally be applied at a temperature from 100 to 600° C. This is because the TS level can be controlled properly by the overaging treatment described above. At a temperature lower than 100° C., TS can not be controlled and no desired tempering effect can be obtained. It is more preferably 200° C. or higher. However, when it exceeds 600° C., it results in a problem such as precipitation of cementite to lower TS. It is more preferably 500° C. or lower. Further, it is recommended to properly control the processing time depending on the demanded TS level or the like and it is generally preferred to control it from 10 to 200 sec (more preferably, 30 sec or more and 150 sec or less).

(2) [Hot rolling step]→[cold rolling step]→[first continuous annealing step]→[second continuous annealing step or galvanization step]

Figure 4:
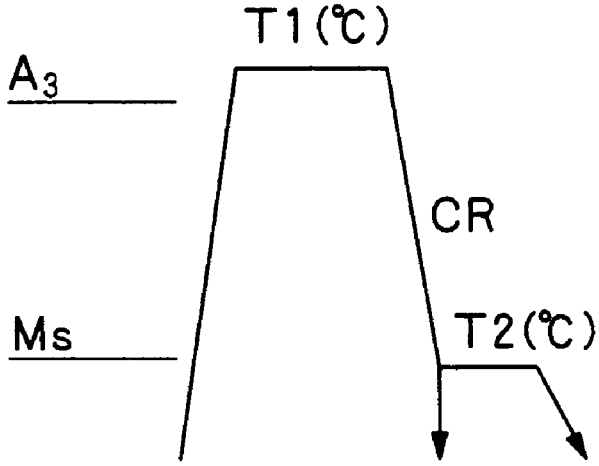
FIG. 4 is an explanatory view for the first continuous annealing step in the method (2) in which a matrix phase is tempered martensite.
Figure 5:
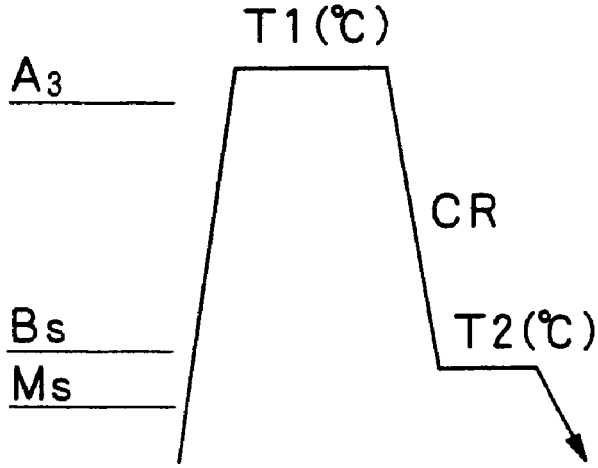
FIG. 5 is an explanatory view for the first continuous annealing step in the method (2) in which a matrix phase is tempered bainite.

The method (2) described above is a method of producing a desired steel sheet by way of the hot rolling step, the cold rolling step, the first continuous annealing step, the second continuous annealing step or galvanization step. Explanatory views for the first continuous annealing step characterizing the method described above are shown in FIG. 4 (in a case where the matrix phase is quenched martensite) and FIG. 5 (where the matrix phase is quenched bainite).

At first, the hot rolling step and the cold rolling step are applied. The steps are not particularly restricted and conditions practiced usually can be properly selected and adopted. This is because the desired structure is not ensured by the steps in the method described above but the method has a feature in controlling the first continuous annealing step, and the second continuous annealing step or galvanization step to be practiced subsequently to obtain a desired structure.

Specifically, for the hot rolling step, it is possible to adopt conditions such as cooling at an average cooling rate of about 30° C./s and coiling the same at a temperature of about 500 to 600° C. after completing the hot rolling at $A_{\gamma 3}$ or higher. Further, it is recommended for the cold rolling step to apply cold rolling at a cold rolling ratio of about 30 to 70%. They are no way restrictive.

Then, (iii) first continuous annealing step and (iv) second continuous annealing step or galvanization step characterizing the method (2) above are to be explained below.

(iii) First continuous annealing step (initial continuous annealing step)

The step described above includes a step of heating and retaining at $A_3$ point or higher; and a step of cooling at an average cooling rage of 20° C./s or more down to a temperature of Ms point or lower, or Ms point or higher and Bs point or lower. The conditions are set so as to obtain a desired matrix phase (quenched martensite or quenched bainite).

At first, after soaking to a temperature of $A_3$ point or higher (T1 in FIG. 4 and FIG. 5) (preferably 1300° C. or lower), a desired quenched martensite or quenched bainite is obtained by controlling the average cooling rate (CR in FIG. 4 and FIG. 5) at 20° C./s or higher (preferably, 30° C./s or higher), and cooling down to the temperature of Ms point or lower (T2 in FIG. 4) or down to the temperature of Ms point or higher and Bs point or lower (T2 in FIG. 5) while avoiding ferritic transformation or pearlitic transformation.

In this case, when the average cooling rate (CR) is lower than the range described above, ferrite or pearlite is formed failing to obtain a desired structure. There is no particular restriction for the upper limit and a higher rate is more preferred but it is recommended to properly controlling the rate in view of the practical operation level.

(iv) Second continuous annealing step (subsequent continuous annealing step) or galvanization step The step described above includes a step of heating up to a temperature of $A_1$ point or higher and $A_3$ point or lower; a step of cooling at an average cooling rate of 3° C./s or higher down to a temperature of Ms point or lower; and a step of further applying, optionally, an overaging treatment at a temperature from 100 to 600° C.

The step is identical with (ii) continuous annealing step or galvanization step in the method (1) described above and it is set for tempering the matrix phase formed in the first continuous annealing step (iii) (quenched martensite or quenched bainite) to obtain a desired tempered martensite or tempered bainite, as well as form a second phase (martensite).

B: Steel sheet in which the matrix phase is a mixed structure of (tempered martensite and ferrite) or (tempered bainite and ferrite); and the second phase is martensite The typical production method for the steel plate described above can include the following method (3) or (4).

(3) [Hot rolling step]→[continuous annealing step or galvanization step]

This is a method of producing a desired steel sheet by way of (i) hot rolling step and (ii) continuous annealing step or galvanization step. Explanatory views for (i) hot rolling step are as shown in FIG. 1 (a case where the matrix phase is quenched martensite+ferrite) and in FIG. 2 (a case where the matrix phase is quenched bainite+ferrite) respectively. The explanatory view for (ii) continuous annealing or galvanization step is as shown in FIG. 3 described above.

(i) Hot rolling step

The hot rolling step includes a step of completing the finish rolling at a temperature of ($A_{\gamma 3}$-50)° C. or higher; and a step of cooling at an average cooling rate of 10° C./s or more down to a temperature of Ms point or lower (in a case where the matrix phase is quenched martensite+ferrite) or Ms point or higher and Bs point or lower (in a case where matrix structure is quenched bainite+ferrite), followed by coiling.

The hot rolling conditions are set for obtaining a desired matrix phase (mixed structure of quenched martensite+ferrite or quenched bainite+ferrite), and details therefor are as described in (i) hot rolling step in the method (1) described above.

After the hot rolling finishing, cooling is conducted. In this invention, a desired mixed structure can be obtained by partially forming ferrite during cooling into dual $\alpha+\gamma$ phase by controlling the cooling rate (CR) and, further, by cooling to a temperature at Ms point or lower or Ms point or higher and Bs point or lower.

In this case, the following method (a), preferably, the method (b) can be mentioned for the cooling conditions described above.

(a) One Step Cooling:

That is, cooling is conducted at an average cooling rate of 10° C./s or more (preferably, 20° C./s or more) down to a temperature of Ms point or lower, or Ms point or higher and Bs point or lower while avoiding pearlitic transformation. In this case, a desired mixed structure (quenched martensite+ferrite or quenched bainite+ferrite) can be obtained by properly controlling the average cooling rate. In this invention, it is recommended to control ferrite to 5% or more and less than 30%. In this case, the average cooling rate is preferably controlled to 30° C./s or more.

Further, the average cooling rate after the hot rolling gives effects not only on the formation of the ferrite but also on the area ratio of the formed structure (tempered martensite/tempered bainite+ferrite) and a lath-like structure is formed when the average cooling rate is high (preferably, 50° C./s or more). There is no particular restriction on the upper limit of the average cooling rate and higher rate is preferred. However, it is preferred to control the cooling rate in relation with the practical operation level.

Further, in order to form the desired mixed structure further efficiently during cooling, it is recommended to include (b) two stage cooling: that is, a step of cooling ① at an average cooling rate (CR1) of 30° C./s or more down to a temperature region within a range from 700±100° C. (preferably, 700±50° C.); ② a step of conducting air cooling in the temperature region for 1 to 30 sec; and ③ a step of cooling at an average cooling rate (CR2) of 30° C./s or higher down to a temperature of Ms point or lower, or Ms point or higher and Bs point or lower after air cooling, followed by coiling. The stepwise cooling described above can form polygonal ferrite at low dislocation density further reliably.

In this case, both in the temperature region ① and the temperature ③ described above, it is recommended to conduct cooling at an average cooling rate of 30° C./s or more, preferably, 40° C./s or more. There is no particular restriction on the upper limit of the average cooling rate and a higher rate is preferred. However, it is recommended to properly control the rate in relation with the practical operation level.

Further, in the temperature region ② described above, air cooling is preferably conducted for 1 sec or more, preferably, 3 sec or more, by which a predetermined amount of ferrite can be obtained efficiently. However, when the air cooling time exceeds 30 sec, ferrite is formed in an amount exceeding a preferred range failing to obtain a desired strength and, in addition, stretch flange formability is deteriorated. It is preferably 20 sec or less. The coiling temperature (CT) is as described in (l)-(i).

Further, in the hot rolling step, it is recommended to properly control each of the steps described above in order to obtain a desired matrix phase, conditions practiced usually (for example, about 1000 to 1300° C.) may properly be selected for other step conditions, for example, heating temperature.

(ii) Continuous annealing or galvanization step

Succeeding to (i) hot rolling described above, continuous annealing or galvanization is applied. However, in a case where the shape after the hot rolling is poor, cold rolling may be applied with an aim of amending the shape after conducting (i) hot rolling and before conducting (ii) continuous annealing or galvanization. It is recommended to define the cold rolling rate as 1 to 30%, because rolling load increases making cold rolling difficult when cold rolling is applied at a ratio exceeding 30%.

The continuous annealing or galvanization includes a step of heating at a temperature of $A_1$ point or higher and $A_3$ point or lower; and a step of cooling at an average cooling rate of 3° C./s or higher down to a temperature of Ms point or lower, optionally, a step of further applying overaging at a temperature of 100 to 600° C. The conditions described above are set for tempering the matrix phase formed in the hot rolling step to form a desired mixture (tempered martensite+ferrite, or tempered bainite+ferrite) as well as forming the second phase (martensite), and the details are as described in (ii) continuous annealing step or galvanization step in the method (1) described above.

(4) [Hot rolling step]→[cold rolling step]→[first continuous annealing step]→[second continuous annealing step or galvanization step]

Figure 6:
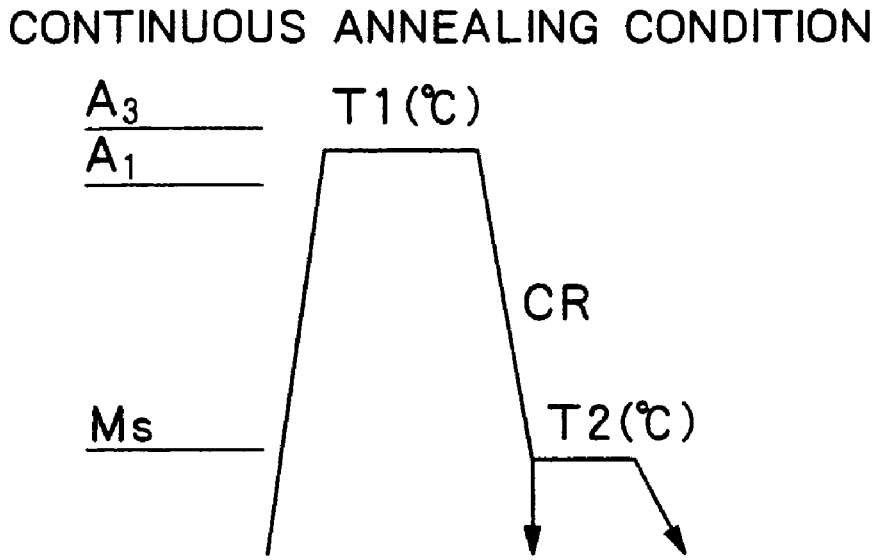
FIG. 6 is an explanatory view for the first continuous annealing step in the method (2) in which a matrix phase is tempered martensite+ferrite.
Figure 7:
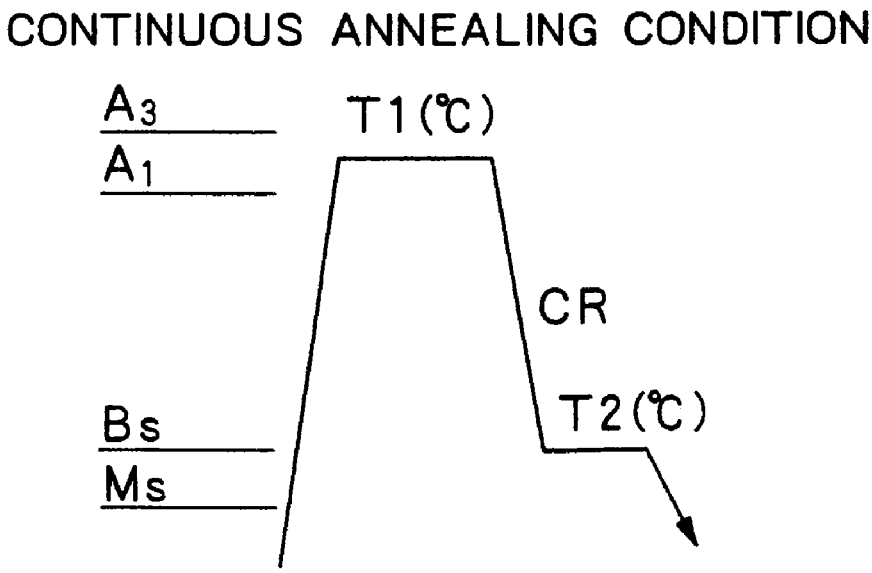
FIG. 7 is an explanatory view for the first continuous annealing step in the method (2) in which a matrix phase is tempered bainite+ferrite.

The method (4) is a method for producing a desired steel sheet by way of the hot rolling step, the cold rolling step, the first continuous annealing step, and the second continuous annealing step or galvanization step. Among them, the explanatory view for the first continuous annealing step characterizing the method (4) above is shown in FIG. 6 in a case where the matrix phase is quenched martensite+ferrite and in FIG. 7 in a case where the matrix phase is quenched bainite+ferrite, respectively.

At first, the hot rolling step and cold rolling step are applied. There are no particular restrictions on the step and conditions adopted usually are properly selected and used, and details therefor are as described in the method (2) above.

Then, (iii) first continuous annealing step and (iv) second continuous annealing step or galvanization step characterizing the method (4) described above are to be described.

(iii) First continuous annealing step (initial continuous Annealing step)

The step described above includes a step of heating to and retaining at a temperature of $A_1$ point or higher and $A_3$ point or lower; and a step of cooling at an average cooling rate of 10° C./s or more down to a temperature of Ms point or lower (in a case where the matrix phase is quenched martensite+ferrite), or Ms point or higher and Bs point or lower (in a case where the matrix phase is quenched bainite+ferrite). The conditions are set for obtaining a desired matrix phase.

At first, it is soaked to a temperature at $A_1$ point or higher and $A_3$ point or lower (T1 in FIG. 6 and FIG. 7) (preferably, 1300° C. or lower). A desired (a+quenched martensite) or (a+quenched bainite) is obtained by partially forming ferrite into dual-phase [ferrite ($\alpha$)+$\gamma$] and cooling down to a temperature of Ms point or lower, or Ms point or higher and Bs point or lower, during soaking in a case of soaking at a temperature $A_1$-$A_3$ or during cooling in a case of soaking at a temperature of $A_3$ point or higher.

After the soaking, when cooling is conducted at the average cooling rate (CR) controlled to 10° C./s or higher (preferably, 20° C./s or higher) down to a temperature of Ms point or lower (T2 in FIG. 6) or Ms point or higher and Bs point or lower (T2 in FIG. 7) a desired mixed structure (quenched martensite+ferrite or quenched bainite+ferrite) is obtained while avoiding pearlitic transformation. In this invention, it is recommended to control ferrite to 5% or more and less than 30%. In this case, it is preferred to control the average cooling rate to 30° C./s or higher.

Further, the average cooling rate gives effects not only on the formation of ferrite but also on the form of final martensite, and the lath-like structure is decreased as the average cooling rate is higher (preferably, 50° C./s or more). There is no particular restriction on the upper limit of the average cooling rate and a higher rate is preferred. However, it is recommended to properly control the rate in relation with the practical operation level.

(iv) Second continuous annealing step (subsequent continuous annealing step) or galvanization step The step described above includes a step of heating at a temperature of $A_1$ point or higher and $A_3$ point or lower; and a step of cooling at an average cooling rate of 3° C./s or more down to a temperature of Ms point or lower; and, optionally, a step of further applying overaging at a temperature from 100 to 600° C. The step is identical with (iv) second continuous annealing step or galvanization step in the method (ii) described above and is set for tempering the mixed matrix phase formed in (iii) first continuous annealing step to obtain a desired mixed structure, as well as for forming the second phase (martensite).

This invention is to be described specifically with reference to examples. However, this invention is not restricted by the following examples and all of modifications within a range not departing the gist described above and to be described later are encompassed with the technical scope of the invention.

EXAMPLE 1

Chemical Compositions and Production Conditions (Matrix Phase of Mixed Structure Comprising Tempered Bainite+Ferrite)

In this example, test specimens of compositions described in Table 1 (Nos. 1-9 in Table 1: unit in the table is mass %) were prepared by vacuum melting into experimental slabs and, after obtaining hot rolled steel sheets of 3.2 mm thickness in accordance with the production method (4) described above (first continuous annealing→second continuous annealing), surface scales were removed by pickling and the sheets were cold rolled down to 1.2 mmt (Nos. 1-9 in Table 2).

The production conditions are as below. At first, after heating and retaining keeping each steel sheet at a temperature of $A_1$ point or higher and $A_3$ point or lower (850° C.) for 60 sec, were cooled down at an average cooling rate of 30° C./s to a temperature of Ms point or higher and Bs point or lower (400° C.) (first continuous annealing treatment). Then, the sheet were retained at a temperature of $A_1$ point or higher and $A_3$ point or lower (800° C.) for 60 sec, then cooled at an average cooling rate of 5° C./s down to 700° C. and further cooled at an average cooling rate of 30° C./s to a room temperature (second continuous annealing treatment) to obtain steel sheets of Nos. 1-9 in Table 2. Among them, No. 3 specimen in Table 2 was cooled to a room temperature at an average cooling rate of 30° C./s and then applied with overaging treatment at 350° C. for 3 min with an aim of controlling strength, in order to confirm the effect by the averaging.

For comparison, test specimen steels Nos. 2-9 in Table 1 were applied only with the second continuous annealing treatment while saving the first continuous annealing treatment described above to obtain steel sheets Nos. 10 to 17 in Table 2. Among them, specimen No. 11 in Table 2 was cooled to a room temperature at an average cooling rate of 30° C./s and then applied with overaging treatment at 350° C. for 3 min with an aim of controlling strength, in order to confirm the effect by the averaging.

For each of the thus obtained steel sheets, tensile strength (TS), elongation [total elongation (EI)], yield strength (YP), yield ratio (YR) and stretch flange formability (hole expansion rate: λ) were measured, respectively, as below.

At first, for the tensile test, JIS No. 5 test specimen was used, and tensile strength (TS), elongation (EI) and yield strength (YP) were measured. The yield ratio (YR) was calculated as [YP/TS]×100 (%).

Further, for the stretch flange formability test, a disk-like test specimen of 100 mm diameter and 2.0 mm thickness was used. Specifically after punching a hole of 10 mmφ, hole expansion was applied on burs by a 60° conical punch, to measure the hole expansion rate (λ) at the crack penetration (Iron and Steel Federal Standards JFST 1001).

Further, the steel sheet was applied with LePera corrosion and the micro-structure at 1/4 t along the cross section in the cold rolling direction (cross section in L-direction) was observed by an optical microscope (×1000). The area ratio for each of micro-structure was evaluated by image analysis of the photograph for the structure subjected to LePera corrosion as described above.

Further, the BH amount and the ΔTS amount were measured for the steel sheet by the following methods.

At first, for the BH amount, a tensile test specimen (usually JIS No. 5 test specimen) was pulled to nominal 2% strain to measure the deformation stress $\sigma_1$ and, after removing the load and keeping the test specimen at 170° C. for 20 min, it was again applied with the tensile test to measure the upper yield stress $\sigma_2$ (stress corresponding to 0.2% strength in a case where yield point was not observed). Then, the difference between $\sigma_1$ and $\sigma_2$ was defined as the BH amount.

Further, for the ΔTS amount, a tensile test specimen (usually JIS No. 5 test specimen) was applied with nominal 10% tensile strain and, after removing the load and keeping the test specimen at 170° C. for 20 min, it was again applied with the tensile test to measure the maximum stress T2. (When the upper yield point exists, the maximum stress except the upper yield stress is measured.) The difference between T2 and the maximum stress T1 when applied with a tensile test till rupture without heat treatment (T2−T1) was defined as the ΔTS amount. The results are shown in Table 2.

TABLE 1

| | | | | | | | | | | |
|---|---|---|---|---|---|---|---|---|---|---|
| | | | | | | TB + PF + low C | | | | |
| No. | C | Si | Mn | P | S | Cr | Mo | sol.Al | N | Others |
| 1 | 0.003 | 0.4 | 2.1 | 0.02 | 0.005 | 0.4 | — | 0.032 | 0.0034 | |
| 2 | 0.04 | 0.1 | 1.6 | 0.01 | 0.005 | 0.5 | — | 0.045 | 0.0042 | |
| 3 | 0.11 | 0.1 | 2.2 | 0.02 | 0.006 | — | — | 0.037 | 0.0045 | |

TABLE 1-continued

| | | | | | | | | | | |
|---|---|---|---|---|---|---|---|---|---|---|
| | | | | | TB + PF + low C | | | | | |
| No. | C | Si | Mn | P | S | Cr | Mo | sol.Al | N | Others |
| 4 | 0.06 | 0.1 | 1.6 | 0.01 | 0.004 | — | 0.3 | 0.028 | 0.0033 | |
| 5 | 0.05 | 0.1 | 1.5 | 0.02 | 0.004 | 0.5 | — | 0.029 | 0.0029 | Ni; 0.30, Cu; 0.30 |
| 6 | 0.06 | 0.2 | 1.5 | 0.01 | 0.005 | 0.6 | — | 0.035 | 0.0031 | Ti; 0.03 |
| 7 | 0.06 | 0.2 | 1.5 | 0.01 | 0.006 | 0.6 | — | 0.047 | 0.0023 | REM; 0.02 |
| 8 | 0.05 | 0.4 | 0.8 | 0.02 | 0.006 | — | 0.5 | 0.055 | 0.0046 | B: 0.008 |
| 9 | 0.05 | 0.1 | 1.4 | 0.02 | 0.006 | 0.5 | — | 0.033 | 0.0054 | |

TABLE 2

| No. | Steel species | Martensite (%) | Ferrite (%) | Tempered B (%) | Others (%) | TS (Mpa) | El (%) | λ (%) | YP (Mpa) | YR (%) | TS × El | TS × λ | BH (MPa) | ΔTS (MPa) |
|---|---|---|---|---|---|---|---|---|---|---|---|---|---|---|
| 1 | 1 | 0 | 30 | — | BF:70 | 483 | 32 | 121 | 303 | 63 | 15456 | 58443 | 21 | 2 |
| 2 | 2 | 11 | 54 | 35 | — | 498 | 36 | 115 | 271 | 54 | 17928 | 57270 | 56 | 27 |
| 3 | 3 | 25 | 27 | 48 | — | 648 | 28 | 83 | 367 | 57 | 18144 | 53784 | 65 | 25 |
| 4 | 4 | 16 | 15 | 69 | — | 594 | 28 | 99 | 288 | 48 | 16632 | 58806 | 69 | 15 |
| 5 | 5 | 12 | 48 | 40 | — | 641 | 30 | 111 | 329 | 51 | 19230 | 71151 | 73 | 20 |
| 6 | 6 | 15 | 42 | 43 | — | 590 | 30 | 97 | 301 | 51 | 17700 | 57230 | 65 | 21 |
| 7 | 7 | 15 | 46 | 39 | — | 503 | 34 | 105 | 278 | 55 | 17102 | 52815 | 54 | 26 |
| 8 | 8 | 12 | 53 | 35 | — | 628 | 25 | 104 | 312 | 50 | 15700 | 65312 | 50 | 19 |
| 9 | 9 | 12 | 44 | 44 | — | 527 | 35 | 100 | 278 | 53 | 18445 | 52700 | 65 | 22 |
| 10 | 2 | 12 | 88 | — | — | 492 | 35 | 36 | 261 | 53 | 17220 | 17712 | 37 | 17 |
| 11 | 3 | 29 | 71 | — | — | 622 | 26 | 25 | 322 | 52 | 16172 | 15550 | 44 | 15 |
| 12 | 4 | 14 | 86 | — | — | 603 | 28 | 24 | 291 | 48 | 16884 | 14472 | 35 | 5 |
| 13 | 5 | 11 | 89 | — | — | 637 | 28 | 25 | 332 | 52 | 17836 | 15925 | 35 | 10 |
| 14 | 6 | 17 | 83 | — | — | 591 | 29 | 23 | 290 | 49 | 17139 | 13593 | 37 | 11 |
| 15 | 7 | 16 | 84 | — | — | 509 | 34 | 33 | 263 | 52 | 17306 | 16797 | 33 | 16 |
| 16 | 8 | 12 | 88 | — | — | 623 | 26 | 19 | 317 | 51 | 16198 | 11837 | 42 | 9 |
| 17 | 9 | 11 | 89 | — | — | 521 | 34 | 35 | 291 | 56 | 17714 | 18235 | 35 | 12 |

Note:
BF = Bainitic ferrite

From the result described above, it can be considered as below (all "No." means herein "Experiment No." in Table 2)

At first, Nos. 2-9 are example of preparing a predetermined tempered matrix phase (mixed structure of tempered bainite+ ferrite) by a method defined in this invention. It can be seen that they are excellent in stretch flange formability compared with other steel sheets (Nos. 1, 10-17) having no tempered bainite, as well as the BH amount and the ΔTS amount were increased as about 20 to 30 MPa and about 10 MPa, respectively, to provide good characteristics.

In contrast, the following examples not satisfying any one of the conditions defined in this invention have the following drawbacks, respectively.

At first, No. 1 is an example of with insufficient amount of C in which no desired tempered bainite and martensite could be obtained. In this steel sheet, a dual-phase steel sheet of bainitic ferrite and ferrite was obtained and strength-elongation balance (TS×EI) was worsened somewhat.

Nos. 10 to 17 are examples in which existent DP steel sheets of ferrite and martensite were obtained since the first continuous annealing treatment was not applied, and they were deteriorated in the stretch flange formability and poor in the strength-elongation flange balance (TS×λ). Further, both the BH amount and the ΔTS amount were low.

Figure 8:
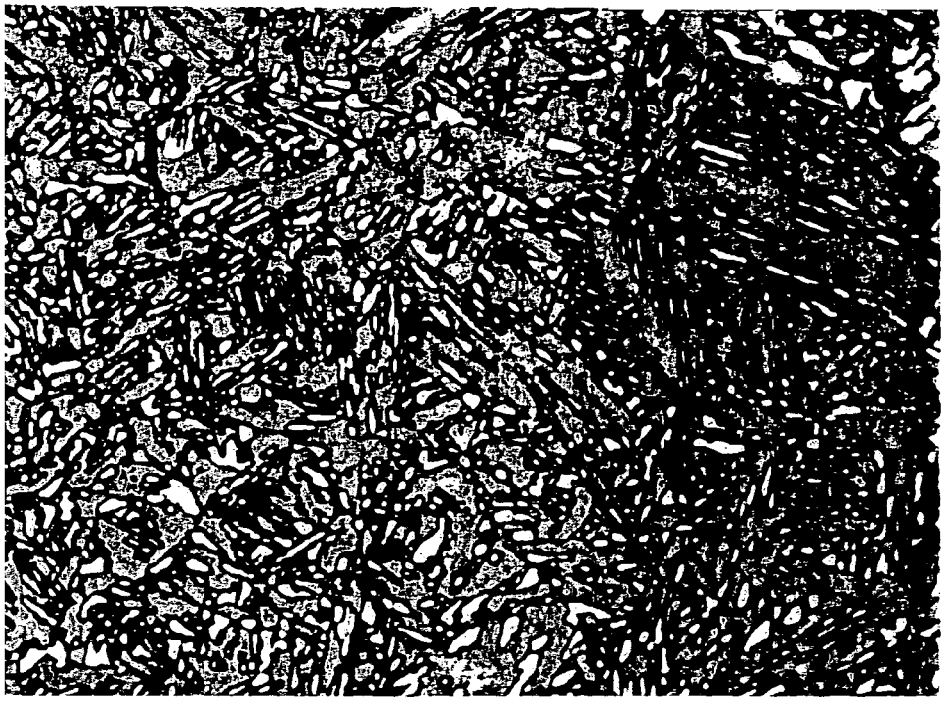
FIG. 8 is an optical microscopic photograph for No. 3 specimen in Example 1.
Figure 9:
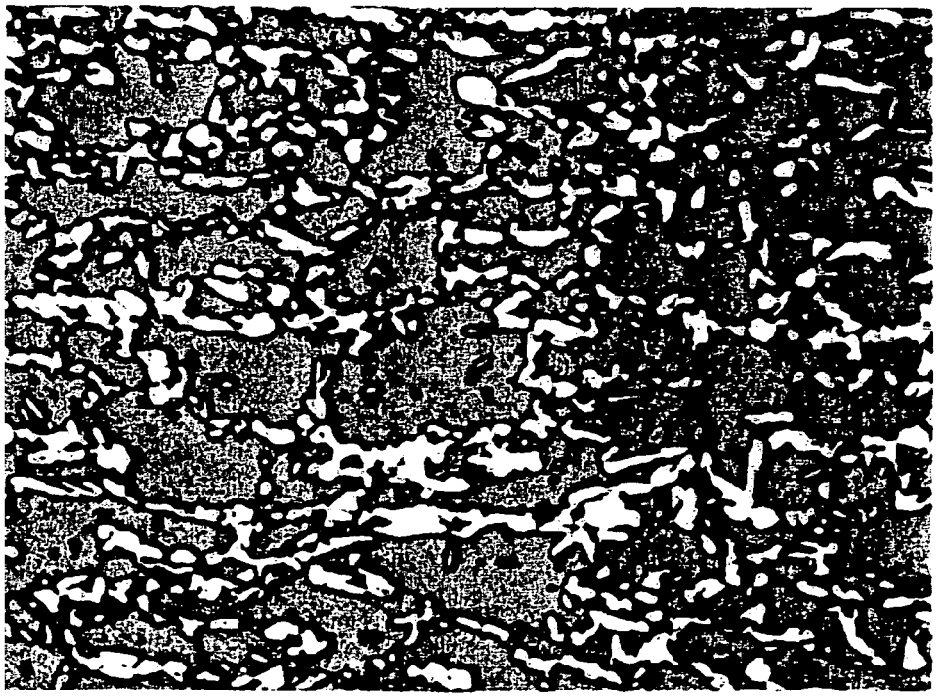
FIG. 9 is an optical microscopic photograph for No. 11 specimen in Example 1.

For the reference, FIG. 8 and FIG. 9 show optical microscopic photographs (magnification: ×1000) for invented steel sheets (No. 3) and comparative steel sheet (No. 11), respectively. It can be seen from the photographs that the invented steel sheet (FIG. 8) comprises tempered bainite and ferrite exhibiting a distinct lath-like structure as the matrix phase in which fine martensite is dispersed in the tempered bainite, whereas such structure was not obtained in the comparative steel sheet (FIG. 9).

EXAMPLE 2

Production Conditions

In this example, steel sheets having various structures shown as Nos. 1-9 in Table 3 were obtained by using the experimental slab No. 2 in Table 1 and conducting production under various production conditions shown in Table 3. The sheet thickness was 1.2 mm for all of the sheets except for the hot rolled steel sheet No. 9 (2.0 mm) in Table 3.

Then, structures and various characteristics of the steel sheets were examined in the same manner as in Example 1. The results are shown in Table 4.

TABLE 3

| | | Hot rolling | | | | Cold rolling | Continuous annealing | | | Continuous annealing or galvanization | | | | | | | |
|---|---|---|---|---|---|---|---|---|---|---|---|---|---|---|---|---|---|
| | No. | SRT ° C. | FDT ° C. | CR ° C./s | CT ° C. | Cold rolling ratio % | T1 ° C. | CR ° C./s | T2 ° C. | T3 ° C. | t3 sec | CR ° C./s | T4 ° C. | t4 sec | Zn→GA ° C. | Steel species | Desired structure |
| Hot rolling cold rolling→ First continuous annealing→ Second continuous annealing | 1 | 1150 | 850 | 40 | 550 | 50 | 900 | 20 | 200 | 800 | 60 | 10 | 460 | 10 | 550 | GA | TM100% |
| | 2 | 1150 | 850 | 40 | 550 | 50 | 850 | 20 | 200 | 800 | 60 | 10 | 460 | 10 | 550 | GA | TM60% + F40% |
| | 3 | 1150 | 850 | 40 | 550 | 50 | 900 | 20 | 400 | 800 | 60 | 10 | 460 | 10 | 550 | GA | TB100% |
| | 4 | 1150 | 850 | 40 | 550 | 50 | 850 | 20 | 400 | 800 | 60 | 10 | 460 | 10 | 550 | GA | TB60% + F40% |
| | 5 | 1150 | 850 | 40 | 550 | 50 | 850 | 20 | 400 | 800 | 60 | 10 | 460 | 10 | — | GI | TB60% + F40% |
| | 6 | 1150 | 850 | 40 | 550 | 50 | 850 | 20 | 400 | 800 | 60 | 10 | 460 | 10 | — | Cold rolling | TB60% + F40% |
| | 7 | 1150 | 850 | 40 | 550 | 50 | — | — | — | 800 | 60 | 10 | 460 | 10 | 550 | GA | F100% |
| | 8 | 1150 | 850 | 40 | 550 | 50 | — | — | — | 800 | 60 | 10 | 400 | 10 | 550 | GA | F100% |
| Hot rolling→ Continuous annealing | 9 | 1150 | 850 | 40 | 400 | — | — | — | — | 800 | 60 | 10 | 460 | 10 | — | Hot rolling | TB6.5% + F3.5% |

Note:
F = ferrite.
TM = tempered martensite
TB = tempered bainite
GA = alloyed molten Zn galvanized steel sheet
GI = molten Zn galvanized steel sheet

TABLE 4

| No. | YP MPa | TS MPa | EL % | λ % | YR % | TS × EL | TS × λ | BH (MPa) | ΔTS (MPa) |
|---|---|---|---|---|---|---|---|---|---|
| 1 | 265 | 495 | 36 | 120 | 54 | 17820 | 59400 | 52 | 20 |
| 2 | 273 | 491 | 36 | 113 | 56 | 17676 | 55483 | 53 | 22 |
| 3 | 281 | 485 | 37 | 123 | 58 | 17945 | 59655 | 53 | 23 |
| 4 | 271 | 498 | 36 | 115 | 54 | 17928 | 57270 | 56 | 27 |
| 5 | 270 | 504 | 36 | 119 | 54 | 18144 | 59976 | 55 | 20 |
| 6 | 265 | 511 | 35 | 110 | 52 | 17885 | 56210 | 55 | 25 |
| 7 | 256 | 486 | 36 | 38 | 53 | 17496 | 18468 | 23 | 5 |
| 8 | 310 | 452 | 30 | 132 | 69 | 13560 | 59664 | 22 | 6 |
| 9 | 255 | 490 | 38 | 110 | 52 | 18620 | 53900 | 52 | 19 |

At first, Nos. 1-6 and 9 in Table 3 are examples adopting the method (2) or (4).

Specifically, No. 1/No. 3 are examples of applying the method (2) [hot rolling→cold rolling→first continuous annealing second continuous annealing (further alloying treatment)], to obtain galvanized molten Zn alloyed steel sheets (GA) having a matrix phase comprising tempered martensite/tempered bainite: No. 2/No. 4 are examples of applying the method (4) [hot rolling→cold rolling→first continuous annealing second continuous annealing (further alloying treatment)], to obtain galvanized molten Zn alloyed steel sheets having a matrix phase comprising a mixed structure of tempered martensite+ferrite/tempered bainite+ferrite. Further, Nos. 5 and 6 are examples having a matrix structure comprising tempered bainite+ferrite like No. 4. No. 5 is an example of a galvanized molten Zn steel sheet (GI) without applying the alloying treatment and No. 6 is an example of a cold rolled steel sheet without applying alloying treatment. Since each of them is produced by the method defined in this invention, the aimed structure was obtained and excellent characteristics were provided.

Further, No. 9 is an example of a hot rolled steel sheet having a matrix phase comprising a mixed structure of tempered bainite+ferrite by adopting the method (4) above and had excellent characteristics.

On the other hand, No. 7 is an example of producing an existent DP steel sheet without applying the first continuous annealing in the method (3) described above. It was poor in the stretch flange formability, BH and ΔTS and worsened in the balance for elongation-stretch flange formability (TS×μ).

Further, No. 8 is an example of producing an existent TP steel sheet. Specifically, after heating and keeping the steel sheet described above at 800° C. for 60 sec, it was cooled at an average cooling rate of 5° C./s down to 700° C., then cooled at an average cooling rate of 15° C./s down to 400° C., kept at that temperature for 3 min and then cooled down to room temperature. The balance for strength-stretch elongation balance (TS×EI) is poor. BH and ΔTS are low.

EXAMPLE 3

Various kinds of steel sheets were produced by using test steels No. 1-19 satisfying the chemical compositions shown in Table 5 and applying heat treatment under the conditions shown in Table 6 of Table 8. In Table 6, (1)-(4) described in the column "production step" correspond, respectively, to the methods (1)-(4) described previously. That is, the method (1) is a method of producing a steel sheet having a matrix phase comprising tempered martensite or tempered bainite by way of hot rolling step→continuous annealing or galvanization step; the method (2) is a method of producing a steel sheet having a matrix phase comprising tempered martensite or tempered bainite by way of hot rolling step→cold rolling step→first continuous annealing step →second continuous annealing or galvanization step; the method (3) is a method of producing a steel sheet having a matrix phase comprising a mixed structure of (tempered martensitic and ferrite) or tempered bainite and ferrite); the method (4) is a method of producing a steel sheet having a matrix phase comprising a mixed structure of (tempered martensite and ferrite) or tempered bainite or ferrite) by way of a hot rolling step→cold rolling step→first continuous annealing step→second continuous annealing or galvanization step, respectively. Further, in Table 6, "GA" means an galvanized molten zinc alloyed steel sheet, "GI" means galvanized molten zinc steel sheet, "cold rolling" means a cold rolled steel sheet and "hot rolling" means a hot rolled steel sheet respectively.

For each of the steel sheets thus obtained, skin pass rolling (elongation rate 1%) was applied and then tensile strength (TS), elongation [total elongation (EI)] and stretch flange formability (hole expansion rate: λ) were measured, respectively, in accordance with the method in Example 1 and the area ratio for each of the structures was measured. Further, the BH amount and the ΔTS amount were measured in accordance with the methods described previously.

The results are shown in Table 7 or Table 9. In the table, "α" means ferrite and "M" means martensite, respectively. The micro-structure shown in Table 7 represents a relative ratio of tempered martensite (TM), tempered bainite (TB) and ferrite (α) and a minute amount of retained austenite may sometimes be contained as other structure within a range of 5% or less based on the entire structure. Further, "No." in Table 6-Table 9 means "Test Specimen No." in Table 5 respectively.

TABLE 5

| No. | C | Si | Mn | P | S | Cr | Mo | sol.Al | N | Effective N amount |
|---|---|---|---|---|---|---|---|---|---|---|
| 1 | 0.15 | 0.1 | 1.1 | 0.01 | 0.004 | — | 0.3 | 0.028 | 0.0033 | 0 |
| 2 | 0.15 | 0.2 | 1.1 | 0.01 | 0.005 | 0.6 | — | 0.035 | 0.0030 | 0 |
| 3 | 0.07 | 0.1 | 1.5 | 0.01 | 0.005 | 0.3 | — | 0.016 | 0.0041 | 0 |
| 4 | 0.15 | 0.1 | 1.6 | 0.01 | 0.004 | — | 0.3 | 0.015 | 0.0035 | 0 |
| 5 | 0.15 | 0.1 | 1.5 | 0.02 | 0.004 | 0.5 | — | 0.024 | 0.0033 | 0 |
| 6 | 0.16 | 0.2 | 1.5 | 0.01 | 0.005 | 0.6 | — | 0.013 | 0.0037 | 0 |
| 7 | 0.16 | 0.2 | 1.5 | 0.01 | 0.006 | 0.6 | — | 0.022 | 0.0028 | 0 |
| 8 | 0.15 | 0.4 | 0.8 | 0.02 | 0.006 | — | 0.5 | 0.021 | 0.0050 | 0 |
| 9 | 0.15 | 0.1 | 1.4 | 0.02 | 0.006 | 0.5 | — | 0.019 | 0.0036 | 0 |
| 10 | 0.11 | 0.1 | 1.6 | 0.01 | 0.005 | 0.4 | — | 0.010 | 0.0063 | 0.0011 |
| 11 | 0.11 | 0.1 | 2.2 | 0.02 | 0.006 | — | — | 0.015 | 0.0081 | 0.0003 |
| 12 | 0.13 | 0.1 | 15 | 0.02 | 0.005 | 0.5 | — | 0.012 | 0.0088 | 0.0026 |
| 13 | 0.15 | 0.1 | 1.5 | 0.02 | 0.006 | 0.5 | — | 0.016 | 0.0089 | 0.0006 |
| 14 | 0.11 | 0.1 | 1.5 | 0.01 | 0.005 | — | — | 0.016 | 0.0101 | 0.0018 |
| 15 | 0.11 | 0.1 | 1.5 | 0.01 | 0.006 | — | — | 0.013 | 0.0077 | 0.0021 |
| 16 | 0.16 | 0.1 | 1.5 | 0.01 | 0.004 | — | — | 0.013 | 0.0081 | 0.0014 |
| 17 | 0.2 | 0.1 | 1.8 | 0.02 | 0.005 | — | — | 0.018 | 0.0101 | 0.0008 |
| 18 | 0.2 | 0.1 | 1.8 | 0.02 | 0.006 | — | — | 0.014 | 0.0083 | 0.0010 |
| 19 | 0.07 | 0.1 | 1.5 | 0.01 | 0.005 | 0.3 | — | 0.016 | 0.0088 | 0.0005 |

TABLE 6

| | | | | | Hot rolling step* | | | Cold rolling | Continuous annealing step | | | |
|---|---|---|---|---|---|---|---|---|---|---|---|---|
| | Calculated | Calculated | | | | | | | | Soaking | | Cooling stop |
| No. 1 | Ms point ° C. | Bs point ° C. | Kind | Production step | Thickness mm | CR ° C./s | CT ° C. | Thickness mm | Soaking temperature | retention time | CR ° C./s | temperature ° C. |
| 1 | 447 | 667 | GA | Existent | 3.2 | 35 | 550 | 1.2 | — | — | — | — |
| 2 | 443 | 649 | GA | Existent | 3.2 | 35 | 550 | 1.2 | — | — | — | — |
| 3 | 473 | 655 | GA | (3) | 2.0 | 35 | 100 | 1.4 | — | — | — | — |
| 4 | 431 | 622 | GA | (1) | 3.2 | 35 | 500 | 1.2 | — | — | — | — |
| 6 | 425 | 610 | GA | (2) | 3.2 | 35 | 600 | 1.2 | 870 | 20 | 30 | 200 |
| 7 | 425 | 610 | GA | (2) | 2.0 | 35 | 650 | 1.4 | 870 | 20 | 30 | 200 |
| 10 | 449 | 628 | GA | (2) | 2.0 | 35 | 650 | 1.4 | 870 | 20 | 30 | 200 |
| 11 | 436 | 602 | GA | (1) | 3.2 | 35 | 550 | 1.2 | — | — | — | — |
| 13 | 432 | 620 | GA | (2) | 1.6 | 35 | 650 | 1.2 | 870 | 20 | 30 | 200 |
| 17 | 407 | 614 | GA | (1) | 3.2 | 35 | 550 | 1.2 | — | — | — | — |
| 19 | 473 | 655 | GA | (3) | 1.6 | 35 | 100 | — | — | — | — | — |
| 18 | 407 | 614 | GI | (1) | 3.2 | 35 | 500 | 1.2 | — | — | — | — |

TABLE 6-continued

| | Galvanization step** | | | | |
|---|---|---|---|---|---|
| No. 1 | Soaking temperature ° C. | Retention time s | Average cooling rate ° C./s | Alloying temperature ° C. | Alloying temperature retention time |
| 1 | 800 | 60 | 12 | 550 | 15 |
| 2 | 800 | 60 | 12 | 550 | 15 |
| 3 | 810 | 60 | 9 | 550 | 15 |
| 4 | 810 | 60 | 11 | 550 | 15 |
| 6 | 800 | 60 | 12 | 550 | 15 |
| 7 | 810 | 60 | 12 | 550 | 15 |
| 10 | 800 | 60 | 12 | 550 | 15 |
| 11 | 800 | 60 | 12 | 550 | 15 |
| 13 | 810 | 60 | 12 | 550 | 15 |
| 17 | 800 | 60 | 12 | 600 | 15 |
| 19 | 820 | 60 | 11 | 600 | 15 |
| 18 | 800 | 60 | 12 | — | — |

Note:
*890° C. for all FDT, 1200° C. for all SRT in the rolling step
**460° C. for all galvanization temperature, 20 sec for all galvanization retention time in the galvanization step

TABLE 7

| | Micro-structure (relative ratio) | | | | | | | | | | |
|---|---|---|---|---|---|---|---|---|---|---|---|
| | Matrix phase | | | Second | YP | TS | YR | EI | λ | BH | ΔTS |
| No. | TM | TB | α | phase M | (MP) | (MPa) | (%) | (%) | (%) | (MPa) | (MPa) |
| 1 | — | — | 86 | 14 | 310 | 603 | 51 | 28 | 55 | 35 | 5 |
| 2 | — | — | 83 | 17 | 296 | 591 | 50 | 29 | 60 | 37 | 11 |
| 3 | 70 | — | 15 | 15 | 291 | 500 | 58 | 35 | 105 | 69 | 60 |
| 4 | — | 83 | — | 17 | 338 | 594 | 57 | 28 | 100 | 80 | 62 |
| 6 | 70 | — | 12 | 18 | 342 | 570 | 60 | 33 | 97 | 75 | 66 |
| 7 | 85 | — | — | 15 | 266 | 503 | 53 | 34 | 100 | 85 | 70 |
| 10 | 88 | — | — | 12 | 250 | 498 | 50 | 35 | 110 | 88 | 65 |
| 11 | — | 74 | — | 26 | 464 | 829 | 56 | 23 | 60 | 71 | 67 |
| 13 | 82 | — | — | 18 | 333 | 566 | 59 | 34 | 100 | 90 | 81 |
| 17 | — | 70 | — | 28 | 460 | 835 | 55 | 22 | 75 | 101 | 87 |
| 19 | 59 | — | 25 | 16 | 269 | 499 | 54 | 35 | 100 | 88 | 75 |
| 18 | — | 71 | — | 27 | 440 | 831 | 53 | 24 | 64 | 107 | 83 |

TABLE 8

| | | | | | Hot rolling step* | | | | Cold rolling | Continuous annealing step | |
|---|---|---|---|---|---|---|---|---|---|---|---|
| No. | Calculated Ms point ° C. | Calculated Bs point ° C. | Kind | Production step | Thickness mm | FDT ° C. | CR ° C./s | CT ° C. | Cold rolling thickness mm | Soaking temperature ° C. | Soaking retention time s |
| 9 | 435 | 629 | Hot rolling | (1) | 1.6 | 890 | 35 | 500 | — | — | — |
| 5 | 427 | 617 | Cold rolling | (1) | 3.2 | 890 | 35 | 500 | 1.2 | — | — |
| 8 | 453 | 678 | Cold rolling | (1) | 3.2 | 890 | 35 | 500 | 1.2 | — | — |
| 12 | 441 | 625 | Cold rolling | (4) | 3.2 | 890 | 35 | 600 | 1.2 | 800 | 20 |
| 15 | 459 | 665 | Cold rolling | (1) | 3.2 | 890 | 35 | 500 | 1.2 | — | — |
| 14 | 459 | 665 | Cold rolling | (1) | 3.2 | 890 | 35 | 500 | 1.2 | — | — |
| 16 | 436 | 652 | Hot rolling | (1) | 1.6 | 890 | 35 | 500 | — | — | — |

TABLE 8-continued

| | Continuous annealing step | | Continuous annealing step | | | | |
|---|---|---|---|---|---|---|---|
| No. | CR ° C./s | Cooling stop temperature ° C. | Soaking temperature ° C. | Retention time s | Average cooling rate ° C./s | Overaging temperature ° C. | Overaging retention time s |
| 9 | — | — | 820 | 60 | 15 | 200 | 60 |
| 5 | — | — | 810 | 60 | 16 | 200 | 60 |
| 8 | — | — | 820 | 60 | 15 | 200 | 60 |
| 12 | 30 | 200 | 800 | 60 | 16 | 200 | 60 |
| 15 | — | — | 820 | 60 | 15 | 200 | 60 |
| 14 | — | — | 820 | 60 | 15 | 200 | 60 |
| 16 | — | — | 810 | 60 | 16 | 200 | 60 |

Note:
*1210° C. for all SRT in the hot rolling step

TABLE 9

| | Micro-structure (relative ratio) | | | | | | | | | | |
|---|---|---|---|---|---|---|---|---|---|---|---|
| | Matrix phase | | | Second | YP | TS | YR | EI | λ | BH | ΔTS |
| No. | TM | TB | α | phase M | (MP) | (MPa) | (%) | (%) | (%) | (MPa) | (MPa) |
| 9 | — | 87 | — | 13 | 276 | 527 | 52 | 35 | 100 | 78 | 70 |
| 5 | — | 87 | — | 13 | 380 | 641 | 59 | 30 | 101 | 75 | 70 |
| 8 | — | 88 | — | 12 | 330 | 628 | 53 | 25 | 104 | 80 | 72 |
| 12 | 70 | — | 15 | 15 | 365 | 635 | 57 | 32 | 99 | 91 | 80 |
| 15 | — | 77 | — | 23 | 489 | 828 | 59 | 23 | 60 | 93 | 77 |
| 14 | — | 75 | — | 25 | 460 | 830 | 55 | 23 | 62 | 90 | 75 |
| 16 | — | 71 | — | 29 | 420 | 833 | 50 | 23 | 65 | 90 | 70 |

From the results, it can be considered as below.

At first, Nos. 1-2 in Table 7 are examples of existent DP steel sheets obtained by using existent steel species with more sol.Al and less N contents in the steel in which both the BH amount and the ΔTS amount were low, compared with this invention.

In contrast, each of Nos. 3, 4, 6, and 7 in Table 7 and No. 5, 8 and 9 in Table 9 is the invented example produced under the heat treatment conditions according to this invention using steel species in which only the amount of sol.Al was controlled to a low level within the range of this invention. Compared with existent examples of No. 1 and 2 described above, not only the stretch flange formability was improved but also the BH amount and the ΔTS amount were increased remarkably.

Further, Nos. 10, 11, 13 and 17-19 in Table 7 and Nos. 12 and 14-16 in Table 9 are invented examples produced under the heat treatment conditions of the invention using the steel species in which not only the amount of Al but also the amount of N and the amount of effective N were controlled within the range of the invention. Compared with Nos. 3-9 described above, the BH amount and the ΔTS amount were increased further.

Since this invention has been constituted as described above, it can provide dual-phase steel sheet having a low yield ratio, excellent in the balance for strength-elongation and for strength-stretch flange formability, and excellent also in the bake hardening property, as well as a method of efficiently producing such steel sheets described above.

The foregoing invention has been described in terms of preferred embodiments. However, those skilled, in the art will recognize that many variations of such embodiments exist. Such variations are intended to be within the scope of the present invention and the appended claims.

What is claimed is:

1. A dual-phase steel sheet of excellent bake hardening property and stretch flange formability containing C: 0.01-0.20 mass %, Si: 0.5 mass % or less, Mn: 0.5-3 mass %, N: 0.0060 mass % or more, sol.Al: 0.025 mass % or less (inclusive 0 mass %), P: 0.15 mass % or less (exclusive 0 mass %), and S: 0.02 mass % or less (inclusive 0 mass %), wherein the steel sheet comprises as a matrix phase a member selected from the group consisting of tempered bainite; and tempered bainite and ferrite, the steel sheet comprises as a second phase from 1 to 30 area % of martensite, and the steel sheet satisfies the following relation (1):

$$0.0001\% \leqq [N]-(14/27)\times[sol.Al] \leqq 0.001\% \quad (1)$$

where

[N] represents the content of N, and

[sol.Al] represents the content of sol.Al.

2. The dual-phase steel sheet as defined in claim 1, further containing 0.003 mass % or less of B (exclusive 0 mass).

3. The dual-phase steel sheet as defined in claim 1, further containing 1 mass % or less of at least one of Cr and Mo in total (exclusive 0 mass).

4. The dual-phase steel sheet as defined in claim 1, further containing at least one of Ni: 0.5 mass % or less (exclusive 0 mass %), and Cu: 0.5 mass % or less (exclusive 0 mass %).

5. The dual-phase steel sheet as defined in claim 1, further containing at least one of Ti: 0.1 mass % or less (exclusive 0 mass %), Nb: 0.1 mass % or less (exclusive 0 mass %), and V: 0.1 mass % or less (exclusive 0 mass %).

6. The dual-phase steel sheet as defined in claim 1, further containing at least one of Ca: 0.003 mass or less (exclusive 0 mass %), and REM: 0.003 mass % or less (exclusive 0 mass %).

7. A method of producing a dual-phase steel sheet, the method comprising applying to a steel a hot rolling step; and a continuous annealing step or galvanization step, and producing the steel sheet as defined in claim 1, wherein the hot rolling step includes a step of completing finish rolling at a temperature of $(A_{\gamma 3}-50)°$ C. or higher; and a step of cooling at an average cooling rate 20° C./s or more down to Ms point or higher and Bs point or lower, followed by coiling, the continuous annealing step or galvanization step includes a step of heating to a temperature of $A_1$ point or higher and $A_3$ point or lower; a step of cooling at an average cooling rate of 3° C/s or more and cooling down to Ms point or lower; and, optionally, a step of further applying overaging at a temperature from 100 to 600° C., the steel sheet comprises as the matrix phase tempered bainite, and the steel sheet comprises as the second phase from 1 to 30 area % of martensite.

8. A method of producing a dual-phase steel sheet the method comprising applying to a steel a hot rolling step: a cold rolling step; a first continuous annealing step: and a second continuous annealing step or a galvanization step, and producing the steel sheet as defined in claim 1, wherein the first continuous annealing step includes a step of heating to and retaining at a temperature of $A_3$ point or higher; and a step of cooling at an average cooling rate of 20° C./s or more down to a temperature of Ms point or higher and Bs point or lower, the second continuous annealing step or galvanization step includes a step of heating at a temperature of $A_1$ point or higher and $A_3$ point or lower; a step of cooling at an average cooling rate of 3° C./s or more down to a temperature of Ms point or lower; and, optionally, a step of further applying overaging at a temperature from 100 to 600° C., the steel sheet comprises as the matrix phase tempered bainite, and the steel sheet comprises as the second phase from 1 to 30 area % of martensite.

9. A method of producing a dual-phase steel sheet, the method comprising applying to a steel a hot rolling step, and a continuous annealing step or a galvanization step, and producing the steel sheet as defined in claim 1, wherein the hot rolling step includes a step of completing finish rolling at a temperature of $(A_{\gamma 3}-50)°$ C or higher; and a step of cooling and at an average cooling rate of 10° C/s or more down to Ms point or higher and Bs point or lower, followed by coiling, the continuous annealing step or galvanization step includes a step of heating to a temperature of $A_1$ point or higher and $A_3$ point or lower; a step of cooling at an average cooling rate of 30° C./s or more down to Ms point or lower; and, optionally, a step of further applying overaging at a temperature from 100 to 600° C., the steel sheet comprises as the matrix phase tempered bainite and ferrite, and the steel sheet comprises as the second phase from 1 to 30 area % of martensite.

10. The production method as defined in claim 9, wherein the hot rolling step includes a step of completing the finish rolling at a temperature of $(A_{\gamma 3}-50)°$ C. or higher; a step of cooling at an average cooling rate of 30° C/s or more down to a temperature region in a range of 700 ± 100° C.; a step of conducting air cooling for 1 to 30 sec in the temperature region; and a step of cooling at an average cooling rate of 30° C/s or more down to a temperature of Ms point or lower, or Ms point or higher and Bs point or lowers after air cooling, followed by coiling.

11. A method of producing a dual-phase steel sheet, the method comprising applying to a steel a hot rolling step; a, cold rolling step; a first continuous annealing step; and a second continuous annealing step or a galvanization step, and producing the steel sheet as defined in claim 1, wherein the first continuous annealing step includes a step of heating to and retaining at a temperature of $A_1$ point or higher and $A_3$ point or lower; and a step of cooling at an average cooling rate of 10° C./s or more down to a temperature of Ms point or higher and Bs point or lower, the second continuous annealing step or galvanization step includes a step of heating at a temperature of $A_1$ point or higher and $A_3$ point or lower; and a step of cooling at an average cooling rate of 3° C./s or more down to a temperature of Ms point or lower; and, optionally, a step of further applying overaging at a temperature from 100 to 600° C., the steel sheet comprises as the matrix phase tempered bainite and ferrite, and the steel sheet comprises as the second phase from 1 to 30 area % of martensite.

* * * * *